United States Patent [19]

Kohri et al.

[11] Patent Number: 4,973,541

[45] Date of Patent: Nov. 27, 1990

[54] ELECTROSTATIC LATENT IMAGE DEVELOPER COMPRISING CAPSULE TONER OF IRREGULAR SHAPE, WRINKLED SURFACE

[75] Inventors: Toshitaro Kohri, Higashiosaka; Junji Machida, Toyonaka; Masahiro Anno, Sakai, all of Japan

[73] Assignee: Minolta Camera Kabushiki Kaisha

[21] Appl. No.: 390,508

[22] Filed: Aug. 2, 1989

Related U.S. Application Data

[63] Continuation of Ser. No. 104,039, Oct. 2, 1987, abandoned.

[30] Foreign Application Priority Data

Oct. 3, 1986 [JP] Japan ..... 61-236611
Apr. 6, 1987 [JP] Japan ..... 62-84278
Aug. 7, 1987 [JP] Japan ..... 62-198374

[51] Int. Cl.[5] ..... G03G 09/00

[52] U.S. Cl. ..... 430/111; 430/138; 430/109; 430/108; 525/934; 526/934; 524/901; 428/402.21; 428/402.22

[58] Field of Search ..... 430/109, 111, 138; 525/934; 428/402.22

[56] References Cited

U.S. PATENT DOCUMENTS

| | | | |
|---|---|---|---|
| 3,234,017 | 2/1966 | Wegl | 430/97 |
| 3,392,139 | 7/1968 | Dingman | 430/109 |
| 3.914,181 | 10/1975 | Berg et al. | 430/106.6 X |
| 3,938,992 | 2/1976 | Jadwin et al. | 430/110 X |
| 3,970,571 | 7/1976 | Olson et al. | 430/109 |
| 4,016,099 | 5/1977 | Wellman | 430/111 |
| 4,428,983 | 1/1984 | Nehen et al. | 428/402.21 X |
| 4,592,957 | 6/1986 | Dahm | 430/138 X |
| 4,672,017 | 6/1987 | Kamezaki | 430/122 |
| 4,758,506 | 7/1988 | Lok et al. | 430/111 |

*Primary Examiner*—J. David Welsh
*Attorney, Agent, or Firm*—Burns, Doane, Swecker & Mathis

[57] ABSTRACT

The present invention provides a developer for developing electrostatic latent image which comprises capsule toners and carriers; said capsule toner having many wrinkles or hollows and upheavals and containing liquid in a shell, and the carriers have no sharp edge or a lower specific gravity, the image copied by the developer can be fixed by pressure under low temperature.

18 Claims, 5 Drawing Sheets

ELECTROSTATIC LATEN IMAGE DEVELOPER COMPRISING CAPSULE TONER OF IRREGULAR SHAPE, WRINKLED SURFACE

This application is a continuation of application Ser. No. 104,039, filed Oct. 2, 1987, now abandoned.

BACKGROUND OF THE INVENTION

As a developer for developing electrostatic latant image in electophotography, so-called two-component developer, which consists of a toner and a carrier, has widely known. The carrier is contained for causing the toner to be charged by friction in polarity suitable for developing operation.

Concerning the method for developing the toner, which is carried by carrier, transferred onto image-transfer sheet, and fixed onto the sheet, a pressure fixing method, especially low-pressure fixing method has been noted, because the method does not necessarily require heating for the fixing process. Moreover, the method can be ready for use in a short duration of time. As a toner suitable for the above-mentioned developing method, a capsule toner has been developed.

The following production methods of capsule toner have been proposed, for instance, spray-dry method, interface polymerization method, core-cellvation method, phase separation method, in-situ polymerization method, (these methods are disclosed in the U.S. Pat. Nos. 3,338,991, 3,326,848 3,502,582, etc.)

The capsule toner comprises a core (consisting of, as main components, coloring agents such as carbon black and magnetic powder, fixing resin, and binder such as, wax) and a shell (formed around the core and consisting of, as a main component, resin), wherein the shell is broken when a pressure is applied. The capsule toner has been regarded to be suitable for the pressure-fixing process, because the toner does not require high pressure for fixing operation and is superior in fixability. The conventional capsule toner, however, has not satisfactorily functioned regarding the essential characteristics required as toner.

As an example of such toner, so-called solid core capsule toner, of which core consists of solid wax, has been disclosed in the U.S. Pat. No. 4,259,426. Since the capsule toner of solid core type does not require high pressure for fixing process, it can be easily fixed. On the contrary, specific luster remains on the image after the fixing process, deteriorating the image quality. In addition, the fixing strength is weak, therefore, the image is damaged or smear may be generated when the developed paper is folded or rubbed. The capsule toner of this type has these problems not being solved.

As another example of the capsule toner, so-called liquid core capsule toner, of which core consists of a solvent, a resin for fixing, and a pigment, both which are dissolved in the solvent, has been disclosed in the U.S. Pat. No. 4,442,194. A schematic structure of the liquid core capsule toner is shown in FIG. 5. In the liquid core capsule toner, a shell 3 is broken by applied pressure, and a liquid resin for fixing process oozes out from the capsule and covers the pigment 2 to fix. When a capsule toner of liquid core type is used, the luster, which appears when a solid core type capsule toner is used, does not generally appear on the image after the development process, and excellent image quality can be obtained.

However, when the fixing process is attempted under a low pressure, the fixability is insufficient. Defective cleaning or filming, on the surface of photosensitive sheet may be occur. In addition, when the applied pressure is only enough to break the shell and the surface of the transfer sheet is rough, the toner enters into the clearance between paper fibers, thereby the toner particles not yet fixed, adheres onto the paper causing so-called toner stain.

On the other hand, the capsule toner containing liquid in its core is generally obtained in a shape of sphere having a small surface area. Therefore, since the surface area of the toner is small and the toner does not cause enough friction force when friction is applied to the toner and carrier in order to charge the toner, the electric charge is low and the charging operation does not smoothly start, thereby the toner easily scatters.

In addition, when spherical toner is subjected to running test using a PPC copying machine, which employs blade-cleaning process, toner particles cannot be completely cleaned off from the photoconductive drum and fuse and adhere onto the photoconductive drum when the blade cleaner wipes off the toner. The toner adhered onto the photoconductive drum is charged and developed in the following developing process, thus generating black stripes on the image. These types of toner also have such disadvantages that: since mechanical strength of the toner is low, the capsule is broken due to friction or impact caused by the carrier when stirring the developer; flowability of the developer is lowered; aggregation or clogging of the developer occurs, preventing smooth developing operation.

SUMMARY OF THE INVENTION

The developer consisting of the conventional capsule toner and carrier has the above-mentioned disadvantages. Accordingly, it is an object of the present invention to eliminate such disadvantages and to provide a developer, wherein the capsule toner is not damaged, charging operation starts smoothly, fixability by a low pressure is excellent, and defective cleaning and filming on the surface of photoconductive drum do not occur.

The developer according to the present invention is improved in the capability to be charged of the toner by forming wrinkle-like unevenness on the surface of the capsule toner, at the same time, the characteristics of carrier to be mixed with the toner are specified in order to reduce load applied to the toner when stirring the developer, thereby lowering breakage of capsule toner caused during stirring operation.

DETAILED DESCRIPTION OF THE INVENTION

It is an object of the present invention to provide developer for developing electrostatic latent image, consisting of:

(1) A capsule toner, in which a core material consists of, at least, a solvent of high boiling temperature and a resin for fixing and a coloring agent, both which are dissolved in or dispersed in the solvent, wherein the core material is enclosed in a shell material essentially consisting of a chargeable resin, and the shape factor (SF1) expressed by the following equation should be within the range shown below:

$$SF1=\{(\text{maximum length})^2/\text{area}\}\times(\text{pai}/4)\times 100,$$
$$120\leqq SF1\leqq 180$$

wherein the maximum length is the longest distance between any two points on the circumference of the particle projection the area is a projection area of the particle;

(2) a carrier, which has no sharp edge corner, or whose specific weight is low.

Figure 1:
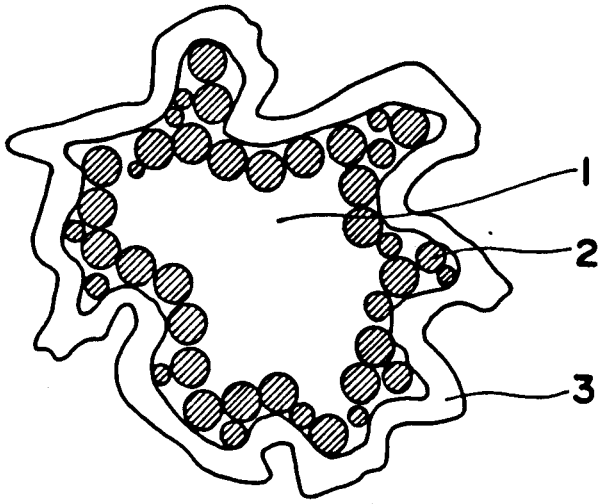
FIG. 1 is a schematic sectional view showing a capsule toner used in the present invention.
Figure 5:
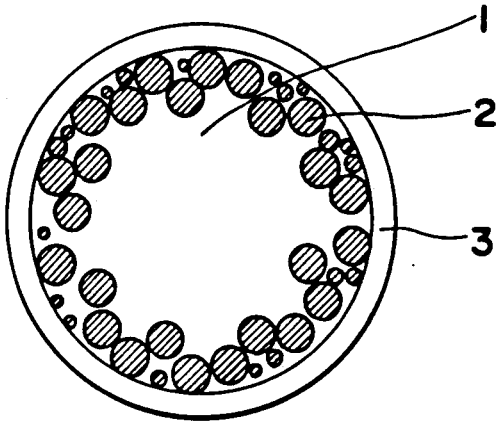
FIG. 5 is a schematic sectional view showing a spherical capsule toner.

The schematic sectional view of the capsule toner according to the present invention was shown in FIG. 1. The capsule toner according to the present invention has wrinkle-like unevenness, more specifically, the shape is such that a plurality of protrusions are not on the surface, but there are a plurality of indentations on the surface. The capsule toner of the present invention comprises a core material consisting of a solvent, and a resin for fixing (1) and a coloring agent (2), both which are liquidized by the solvent, and a shell material (3), which encapsulates the core material and are not dissolved or expanded by the solvent.

The above-mentioned unevenness of the capsule toner can be defined using the shape factor SF1, which is used for expressing shape of particles.

$$SF1=\{(\text{maximum length})^2/\text{area}\}\times\text{pai}/4\times 100$$

wherein the maximum length is the longest distance between any two points on the circumference of the particle projection, the area is a projection area of the particle.

The shape factor SF1 expresses the distortion of particle caused by the difference between the long and short diameters. If the particle is a perfect sphere, the SF1 is 100.

The capsule toner according to the present invention has a SF1 value of 120 through 180, preferably 130 through 180. When the value is smaller than 120, preferable characteristics for charging and cleaning cannot be obtained. If the value exceeds 180, it is difficult to obtain capsule toner.

In this specification, the shape factor SF1 is the value obtained using the IMAGE ANALYZER (RUZEX 5000: manufactured by NIPPON REGULATOR LTD.)

Regarding to the size of the capsule toner according to the present invention, the mean particle diameter is within a range of 3 through 25 microns, preferably from 5 through 20 microns, more preferably from 8 through 17 microns. A toner smaller than 3 microns is inferior in its flowability and fixing and cleaning properties. A toner larger than 25 microns has problems in image quality such as resolution.

The capsule toner according to the present invention can be obtained, for instance, by the following steps:

(a) A core material is prepared by polymerizing a monomer in a solvent to obtain a resin (polymer) solution for fixing, and by dispersing a pigment into the solution; then the shell is formed by enclosing the core material;

(b) A solvent of a high boiling temperature, a monomer, a polymerization initiator, and a coloring agent such as a pigment are mixed to form an emulsion; then while a synthesizing resin for fixing using the in-situ polymerization process, the shell is formed by enclosing the core material.

(c) A resin polymerized in advance is used for a fixing agent, the resin is dissolved into a solvent, at the same time, a pigment is dispersed in the solution; then the solution is used for the core material and the shell is formed by enclosing the core material.

It is especially preferable to use the in-situ polymerization and the interface polymerization in combination.

The mechanism for forming the capsule toner of the present invention is as follows:

(A) In the method where the in-situ polymerization and interface polymerization methods are used in combination, a capsule shell and a resin for fixing are obtained. When the polymerization speed of the shell is faster than that of the resin for fixing, the polymerization reaction of the resin continues after the shell is formed. In this case, since the capacity inside the shell reduces with the advance of the polymerization from monomer to polymer, the shell shrinks to form a rugged shape.

(B) In the method described in (b), the monomer may be in-situ-polymerized, and in some cases with polyol, too. In this case, bridging reaction occurs at the interface between the outside periphery of the core material and the shell inside, thus the shell shrinks to form a rugged shape.

(C) In the method described in (c), a resin for fixing is dissolved in a solvent, and additives such as pigment are added into the solution. The solution prepared in advance is encapsulated in the shell. At this time, the shell is formed at first, and then the organic solvent used for the core material having relatively low boiling point evacuates from fine pores in the shell, thus the shell shrinks to form a rugged shape.

The reasons why the rugged shaped capsule is formed are shown above. In addition, the shape depends on the stirring conditions for obtaining suspension, conditions for forming the capsule shell, boiling point and quantity of the solvent used in the core material, and the type and quantity of suspending and emulsifying agents.

By forming the capsule toner as the rugged shape, the following advantages are obtained; charging operation smoothly starts, and fogging and black stripes generation due to insufficient cleaning can be suppressed.

There are many cases where a capsule toner is mixed with smaller size toner particles. This is because, unlike conventional toners produced by pulverization, fine particles produced through suspension remain without being encapsulated in shells and solidify as small size toner particles. These small size toner particles are considered to cause deterioration of the fixation property and the cleaning property. In a measurement of the particle size distribution of toner, the relative weight distribution by particle sizes, for which the most generalized Coulter counter measurement and indications were studied, fails to show corresponding relations with various properties mentioned above. This is because, even if the small size toner particles, which practically most influence various properties as mentioned above, are contained in a large number, they do not assume any conspicuous proportion in the relative weight distribution by particle sizes.

This will now be considered by studying the number distribution by particle sizes in the manner of comparison, which can be measured and indicated by Coulter counter as well as the weight distribution.

Figure 7:
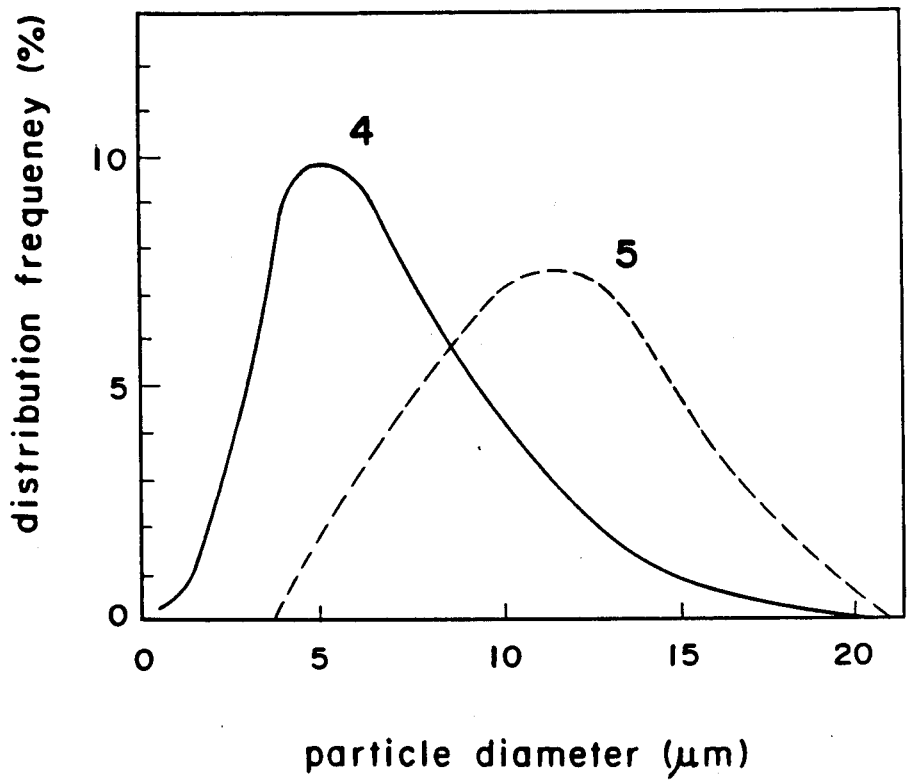
FIG. 7 shows an example of the distribution curve of a toner determined by a Coulter counter.

FIG. 7 shows a distribution curve based on the data determined by Coulter counter. The solid line (4) shows a number distribution by particle sizes, and the broken line (5) a relative weight distribution by particle sizes. As shown by these two curves, the measurement of the same toner sample with the same measuring instrument results in different positions of the curves by particle sizes (average particle sizes) and different shapes of the curves. For example, given spherical particles including ten 2 μm particles and ten 20 μm particles in every 100 particles, (i) the measurement of the number distribution by particle sizes provides the same value of distribution, i.e., 2 μm particles account for 10% and 20 μm particles account for 10%, but (ii) in the measurement of the relative weight particle sizes, 2 μm particles are converted to weight $$V(2\ \mu m) = \frac{4}{3}\pi \times 1^3 = \frac{4}{3}\pi \text{ and}$$

20 m particles are converted to weight $$V(20\ \mu m) = \frac{4}{3}\pi \times 10^3 = \frac{4000}{3}\pi$$

so that a weight ratio $$V(2\ \mu m):V(20\ \mu m) = 1:1000$$

is obtained.

As is clear from the above, 20 μm particles are 1,000 times as large in number as 2 μm particles datawise, although the number of the particles is the same between the two. In other words, small size particles are measured in the relative weight distribution by particle sizes, but they are disregarded in the data processing, hence no value.

It was discovered in the present invention that the small size particles of less than 3 μm, which are difficult to determine in the relative weight distribution by particle sizes, have a large influence upon various properties of capsule toners, the quality of the picture obtained, and properties in running test. For example, the pressure fixation property and the cleaning property are improved and fogging decreases in running test by reducing the particles of less than 3 μm to less than 10% in number. The filming resistance is improved and fogging in brushing resistance decreases by reducing the particles of more than 20 μm to less than 5% in number.

There is now explained how to prepare a capsule toner by the method (a) according to the present invention.

The monomers capable of being polymerized in a resin for fixation according to the present invention include both monofunctional monomers and multifunctional monomers.

The monofunctional monomers are: styrene monomers such as, for example, styrene, alpha-methylstyrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic monomers such as methylacrylate, ethylacrylate, n-propylacrylate, iso-propylacrylate, n-butylacrylate, iso-butylacrylate, tert-butylacrylate, n-amylacrylate, n-hexylacrylate, 2-ethylhexylacrylate, n-octylacrylate, n-nonylacrylate, cyclohexylacrylate, benzylacrylate, dimethylphosphate ethylacrylate, diethylphosphate ethylacrylate, dibutylphosphate ethylacrylate, and 2-benzoiloxy ethylacrylate; methacrylate monomers such as methyl methacrylate, ethyl methacrylate, n-propyl methacrylate, iso-propyl methacrylate, n-butylmethacrylate, iso-butyl methacrylate, tert-butyl methacrylate, n-amyl methacrylate, n-hexylmethacrylate, 2-ethylhexyl methacrylate, n-octyl methacrylate, n-nonyl methacrylate, diethylphosphate ethylmethacrylate, and dibutylphosphate ethylmethacrylate; methylene aliphatic monocarboxylic acid esters; and vinyl monomers including vinyl esters such as, for example, vinyl acetate, vinyl propionate, vinyl benzoate, vinyl butyrate, and vinyl formate, vinyl ethers such as vinyl methyl ether, vinyl ethyl ether, and vinyl isobutyl ether, and vinyl ketones such as vinyl methyl ketone, vinyl hexyl ketone, and methyl isopropylketone.

The multifunctional monomers are, for example: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy diethoxy)phenyl) propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy diethoxy)phenyl) propane, 2,2'-bis(4-(methacryloxy polyethoxy)phenyl) propane, trimethylol propane trimethacrylate, tetramethylol methane trimethacrylate, divinyl benzene, divinyl naphthalene, and divinyl ether.

The monofunctional monomers can be used each singly or two or more of them in combination, or a monofunctional monomer and a multifunctional monomer in combination.

A monomer is used in a proportion of 1–1,000 parts by weight, preferably in a proportion of 50–800 parts by weight, and more preferably in a proportion of 100–700 parts by weight, as against 100 parts by weight of solvent. If used in a larger proportion than 1,000 parts by weight, the polymer is stiff and the firmness of fixation deteriorates. If used in a proportion of less than 1 part by weight, the binder properties deteriorate because of lack of the polymer component.

The solvent selected must not dissolve or swell the shells which are formed at a later step in the manufacturing procedure.

Solvents suitable for the use are, for example, nonane, decane, undecane, dodecane, tridecane, tetradecane aliphatic hydrocarbon such as branched isoparaffin, high boiling point solvent such as an organic polysiloxane expressed by the general formula (I)

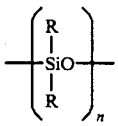

(I)

wherein R represents an alkyl group of methyl type, ethyl type, etc. or phenyl group, and n represents 3 or a higher integer, and liquid paraffin, and mixed solvent of a low boiling point polar organic solvent such as acetone, dichloromethane, methylene chloride, ethylene chloride and tetrahydrofuran. The boiling point of a high boiling point solvent must not exceed 350° C., and is preferably 150–350° C. If the boiling point is higher than 350° C., the vaporization of the solvent after fixation is slow. The boiling point of a low boiling point solvent should be higher than 30° C., and is preferably 30–80° C. If the boiling point is lower than 30° C., the solvent quickly vaporizes during reaction and the viscosity increases.

A polymerization initiator used according to the invention is an oil-soluble initiator soluble in any of the above-mentioned solvents. Examples of the most suitable one for the use are a radical polymerization initiator, for instance, azo compounds such as 2,2'-azo bis-isobutylonitrile, 2,2'-azo bis-2,4 dimethyl valeronitrile, and 2,2'-azo bis-4-methoxy-2,4-dimethyl valeronitrile; and peroxide initiators such as acetyl cyclohexyl sulfonyl peroxide, diisopropyl peroxydicarbonate, decanonyl peroxide, lauroyl peroxide, stearoyl peroxide, propionyl peroxide, acetyl peroxide, t-butylperoxy-2-ethylhexanoate, benzoyl peroxide, t-butylperoxy isobutyrate, cyclohexanone peroxide, methyl ethylketone peroxide, dicumilperoxide, t-butylhydro peroxide, di-t-butylperoxide, and cumene hydroperoxide.

A radical polymerization initiator may be used in a proportion of 0.01–5 parts by weight, preferably 0.5–2 parts by weight, as against 100 parts by weight of monomer. If the use is less than 0.01 part by weight, the polymerization takes place slowly. If the use is more than 5 parts by weight, it is difficult to control the polymerization.

The radical polymerization reaction may be carried out at 50–90° C., preferably at 60–90° C. If the temperature is lower than 50° C., the polymerization takes place slowly. If it is higher than 90° C., the shell may become porous through vaporization of the monomer or solvent, or a low molecular weight polymer may be formed and cause offset to the roller, or aging stability may become inadequate.

It is generally sufficient to allot 4–10 hours to a radical polymerization reaction, though the time may vary depending on the polymerization reaction temperature etc. It is preferable to carry out a radical polymerization reaction in an environment lacking oxygen. Because oxygen functions as a radical scavenger and its presence runs counter to a polymerization reaction. It is therefore desirable for an aliphatic hydrocarbon solvent for the use to be free from dissolved oxygen. Dissolved oxygen can be removed by subjecting the solvent to bubbling in an inert gas, such as nitrogen or argon, for a certain length of time.

Suitable for coloring may be highly magnetic metal powders such as ferrite, magnetite, cobalt and nickel, furnace black which is a conventional black pigment, carbon black such as channel black, copper oxide, non-magnetic pigment such as compound oxides of manganese and copper and those of copper-chrome, polymer beads dyed by various dyes, various inorganic and organic pigments, another dye etc. It is effective as well at the time of the reaction, to dissolve or disperse additives in materials forming shells. The above-mentioned additives can be added before the radical polymerization reaction starts.

A colorant in the above description may be used in a proportion of 5–60 parts by weight, preferably in a proportion of 20–40 parts by weight, as against 100 parts by weight of the monomer used. If the use is less than 5 parts by weight, the shell does not form well and the strength of the shell is inadequate.

Isocyanates, and polyols, too, where necessary, may be used as materials for forming shells.

At a later step of the manufacturing procedure, an isocyanate reacts with an amine or a polyol to form a shell membrane having a urea bonding or urethane bonding.

Isocyanates useful for this purpose are, for example, xylene-1,4-diisocyanate, xylene-1,3-diisocyanate, trimethylene diisocyanate, hexamethylene diisocyanate, propylene-1,2-diisocyanate, butylene 1,2-diisocyanate, ethylidene diisocyanate, cyclohexylidene-1,2-diisocyanate, cyclohexylidene-1,4-diisocyanate, m-phenylene diisocyanate, p-phenylene diisocyanate, 2,6-tolylene diisocyanate, 2,4-tolylene diisocyanate, naphthalene-1,4-diisocynate, diphenyl methane-4,4'- diisocyanate, toluylene diisocyanate, triphenyl methane diisocyanate, polymethylene polyphenyl isocyanate, 4,4'-dimethyl diphenylmethane-2,2',5,5'-tetraisocyanate, addition product of hexamethylene diisocyanate and hexanetriole, addition product of 2,4-tolylenediisocyanate and catechol, and addition product of tolylene diiosocyanate and trimethylol propane, and addition product of xylene diisocyanate and trimethylol propane. Any of these isocyanates can be used each singly or in combination with others.

Polyols useful for the purpose are, for example, ethylene glycol, propylene glycol, 1,4-butanediol, catechol, resorcinol, hydroquinone, 1,2-dihydroxy-4-methylbenzene, 1,3-hydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-bisphenol, p,p'-bisphenol, 1,1'-bi-2-naphthol, bisphenol A, 1,3-propylene glycol, 1,4-butylene glycol, 1,5-pentanediol, 1,6-pentanediol, 1,7-pentanediol, 1,8-octenediol, glycerin and water.

Next, a solvent wherein resin for fixation, coloring agent, polyisocyanate as material for forming the shells, and other necessary additives are dissolved or dispersed is emulsified in an aqueous medium and stirred at a high velocity so as to make the oil drops reduced to a desired size evenly by preventing the fine particles from coagulating.

The sizes of the oil drops are adjusted to 3–20 μm in terms of number average particle sizes, preferably 5–17 m and more preferably 8–15 μm. If the size is more than 20 μm, chargeability of the capsule toner deteriorates. If the size is less than 3 μm, the capsule toner is so small in particle size that the fluidity of the toner deteriorates and the capsule toner tends to coagulate. The size of the oil drops can be adjusted by mechanical stirring by means of a mixer etc.

An oil drop thus obtained contains therein resin for fixation in the state of solution or dispersion, formed by radical polymerization. The oil drop contains colorant or magnetic powder in larger quantities at the outward portion than inside, and such a drop is dispersed in water.

It is desirable to add a dispersion stabilizer in said dispersion liquid in order to prevent fine particles from coagulating. By so doing it becomes possible to produce capsule toner particles of even size. Dispersion stabilizers suitable for the use are gelatin, polyvinyl alcohol, gum arabic, hydroxy methylcellulose, hydroxy ethylcellulose, hydroxy propylcellulose, sodium polyacrylate, anionic surface-active agent, nonionic surface-active agent, cationic surface-active agent, colloidal silica, colloidal alumina, tricalcium phosphate, ferric hydrate, aluminum hydroxide, etc.

Said dispersion liquid is prepared at a temperature in the range 0–15° C., preferably in the range 5–10° C. If the temperature is higher than 15° C., the dispersion liquid tends to react with water.

Next, to the dispersion liquid thus obtained water-soluble polyamines such as ethylene diamine or polyol, each singly or in the form of water solution of the mixture of the two, may be added in such a manner as to cause the isocyanate group to react with amine or hydroxyl group at the interface between said oil drop and water. The reaction forms membrane of polyurethane, that of polyurea, or a compound membrane of the two polymers, which encapsulates the oil drop, thus producing a capsule toner according to the invention.

In cases a polyol is added when the oil drops are formed, the polyol reacts with isocyanate in the oil drops (in situ polymerization) to form an urethane polymer. This urethane polymer ties the colorant or the magnetic powder firmly together, strengthens the polymer structure, and contributes to forming the toner shells.

The shell membrane must have a thickness in the range of 0.01–0.8 μm, preferably in the range of 0.1–0.4 μm. If the thickness is more than 0.8 μm, the shell assumes an excessive strength and is not easy to break when pressure is applied for fixation. If the thickness is less than 0.01 μm, the shell becomes fragile and easily breaks when handled.

Polyamines useful as additives at the interfacial polymerization may be ethylene diamine, trimethylene diamine, tetramethylene diamine, pentamethylene diamine, hexamethylene diamine, p-phenylene diamine, m-phenylene diamine, piperazine, 2-methyl piperazine, 2,5-dimethyl piperazine, 2-hydroxy trimethylene diamine, diethylene triamine, triethylene tetramine, diethyl amino propylamine, tetraethylene pentamine, amino-added product of epoxy compound etc.

Polyols applicable as additives at the interfacial polymerization are the same as those specified in the foregoing description.

The interfacial polymerization is carried out at a temperature in the range 10–60° C., preferably in the range 15–50° C. If it is higher than 60° C., the solvent vaporizes and leaves fine holes in the surface of the shell. If it is lower than 10° C., the reaction takes place slowly and is prolonged.

5–8 hours are sufficient for the interfacial polymerization, although the time depends on the polymerization temperature.

The capsule toner is collected through drying after separation from the liquid medium.

The method (b) for producing a capsule toner according to the invention is carried out as follows:

First, the monomer to form a resin for fixation, colorant, isocyanate to form the shell, and additives according to the method (a), where necessary, are dissolved or dispersed in a solvent, which then is emulsified in water or in water solution of emulsifiers, where necessary by stirring at a high velocity so as to adjust the oil drop of the dispersion therein to a uniform desired size and to prevent fine particles therein from coagulating. Simultaneously, a reaction takes place between isocyanate group and an amine or hydroxyl group, whereby resin membrane of polyurethane or polyurea or their compound membrane is formed at the interface between the oil drop and water so that shells for a capsule toner are thereby formed according to the method (a) already described. In parallel or subsequence with this formation of shells to encapsulate oil drops, the resin for fixation is formed by in-situ polymerization so as to produce a capsule toner.

The method (c) for the production of a capsule toner according to the present invention is to use for the fixation a resin which has preliminarily been polymerized, whether by preparing it from a monomer according to the method (a) or by using a thermoplastic resin generally used for toners of the heat fixation type, such as polyester resin, epoxy resin or polyamide resin. The method (c) is more or less the same as the method (a).

A capsule toner according to the invention can be used both as one component type developer and two component type developer. This capsule toner is capable of being heat fixed at low temperatures, besides being fixable by pressure. Heat fixation at low temperatures can be practiced by lowering Tg of the resin for fixation, the softening point, from the ordinary level of the resins of the heat fixation type.

A capsule toner transferred onto a transfer sheet and adhearing thereto is broken by pressure applied by a fixation roller. When it is broken, the organic solvent vaporizes or penetrates into the transfer sheet, whereas the resin for fixation is fixed to the sheet and solidifies. The colorant wrapped in the resin produces a picture image in thick black.

The fixation does not necessary require heating. But heating quickens the vaporization of the solvent, and ensures good fixation.

The present invention will be described further in detail with reference to examples. The phrase "part by weight" will be shortened to "part(s)" in the examples which follow.

In the preparation method of the capsule toner according to the present invention described in (c), a resin polymerized in advance, (for instance, the resin polymerized from monomer described in (a)), or a thermoplastic resin generally used for a thermally-fixed toner, (for example, polyester resin, epoxy resin, or polyamide resin) can be used as a resin for fixing in the same manner as in the method described in (a).

Preferable properties of the carrier used in an embodiment according to the present invention are as follows: irregularity in shape is low; the mean particle diameter is 80 microns or less and the true specific gravity is 4.5 or less.

When the carrier has minimum irregularity in shape and round edges, the stirring operation of the capsule toner and the carrier is smoothly carried out and the mixed developer has good flowability. Thus, shock is not applied to the capsule toner, preventing breakage of toner particles.

On the other hand, by lowering both the mean diameter and specific weight of the carrier, load of the carrier against the toner particles during stirring operation can be lowered, preventing breakage of toner particles.

In order to improve flowability, it is preferable to use a carrier of minimum irregularity, that is, a spherical carrier is preferable. The following carriers can be used: ferrite carrier (ferrite particles are used without any treatment); spherical iron carrier; carrier produced by coating the surface of ferrite or iron carrier with a resin using the well-known process; and a binder type carrier produced by binding a magnetic powder with a binder resin, and by subjecting to a heat treatment to make spherical shape.

To effectively suppress breakage of a capsule toner, the mean diameter of the carrier to be used is limited within a range of 30 through 100 microns; preferably from 30 to 80 microns; more preferably from 40 to 70 microns.

The above-mentioned irregularity can be defined by the shape factor SF2 in addition to the above-mentioned shape factor SF1.

The shape factor SF2 is defined by the following equation:

$$SF2=\{(\text{circumferential length})^2/\text{area}\}\times 100/4pi$$

wherein the area is a projection area of the particle, the circumferential length is a circumferential length of the particle projection.

The shape factor SF2 expresses the shape unevenness of carrier. If a carrier is a perfect sphere, the SF2 of the carrier is 100.

In order to improve the flowability of the toner, carrier having the above-mentioned shape factor SF1 of 100 through 170 and SF2 of 100 through 140 is used; preferably SF1 from 100 through 160 and SF2 of 100 through 130. When a carrier having the shape factors SF1 and SF2 without the above-mentioned ranges is used, excessive stress may be applied to the capsule toner, resulting in breakage of the capsule toner, resulting in breakage of the capsule.

In this specification, the above-mentioned shape factors SF1 and SF2 are the value obtained using the image analyzer (RUZEX 5000: manufactured by NIPPON REGULATOR LTD.)

As examples of the above-mentioned carrier, the following are used: a ferrite carrier such as FMC-6 or FMC-6C (trade names of products manufactured by TDK LTD.), and F-250HR (manufactured by NIPPONTEPPUN LTD.), an iron powder carrier such as KS-series or KM-series (manufactured by KANTODENKA KOGYO LTD.) It is matter of course that these carriers may be coated with the resin as described above.

In order to obtain sufficient flowability, the following mixing ratio (weight percent of the above-mentioned capsule toner to the above-mentioned carrier) is used: when the toner is of non-magnetic type, 1 through 20%, preferably 3 through 15%; when the toner is of magnetic type, 20 through 60%, preferably 30 through 50%. When a mixing ratio larger than the above-mentioned range is used, the obtained toner is inferior in its changeability, causing scatter of toner particles and resulting in low image quality of fogging. If a mixing ratio smaller than the above-mentioned range is used, the toner cannot reproduce image having the same density as that of the original.

In order to reduce the load to the capsule toner, the carrier of the following properties is recommended irrespective of the developing method to be used (for instance, cascade method, magnetic crush method, etc.): mean particle diameter: 80 microns or less, preferably 15 microns or larger; true specific weight: 4.5 or less, preferably 1.0 through 4.0, more preferably 1.5 through 3.5

As described above, the capsule toner is weak in its mechanical strength. Therefore, the capsule (outer shell) is apt to abrade or break due to contact with the carrier during operation. Accordingly, in order to eliminate this problem, the carrier whose mean particle diameter is 80 microns or less and whose true specific weight is 4.5 or less is used in an embodiment according to the present invention. Preferably, the mean diameter of the carrier should be within a range of the same diameter as that of the toner to be used through 80 microns. If the true specific weight of the carrier exceeds 4.5, the possibility of causing capsule breakage becomes greater. When the specific weight is smaller than 1.0, the carrier may not be mixed with toner uniformly.

If the carrier satisfies the above-mentioned specifications, any carrier such as a ferrite carrier or a coated carrier may be used. A preferable carrier is a binder type carrier. When the binder type carrier is used, its advantage is that it is possible to self-reproduce the carrier deteriorated by fusion or adhering of a spent toner.

That is, the binder type carrier is produced by a binding magnetic fine powder using a binder resin. Since the carrier has a specific weight lower than that of other carrier particles, the carrier does not damage capsule toner when contacting with the toner particles. When the developer is used for a long period of time, a toner adheres onto the surface of the carrier (the adhered toner is referred to as "spent toner"), thus shortening the life span of the developer. When a conventional toner is used, the developer requires to be replaced with a fresh developer each time when the developer is used to develop 15,000 through 20,000 sheets of copies (A4 size). If the binder type carrier is used and even when a spent toner adheres onto the surface of the carrier, the surface abrades and the carrier easily self-refreshes because the surface of the carrier particle is soft. Therefore, even after 200,000 sheets of copies (A4 size) are developed, the carrier does not deteriorate significantly.

A preferable binder type carrier has the following properties:

volume resistance: $10^{12}$ ohm.cm or more; mean particle diameter: 15 through 80 microns, preferably 15 through 70 microns.

The binder type carrier essentially consists of a magnetic powder and a binder resin. As a charge control agent or a resistance control agent, a carbon powder may be added to the carrier if necessary. As the magnetic powder and binder resin (both are the main components of the carrier), the following can be used. Fine particles (mean particle diameter of 3 microns or less, preferably 1.5 microns or less) of magnetite, ferrite, iron, cobalt, etc. may be used as a magnetic powder.

As a binder resin, the following can be used: thermoplastic resin such as polystyrene, polyethylene, polypropylene, vinyl resin, polyacrylate, polymethacrylate, polyvinylidene chloride, polyacrylonitrile, polyether, polycarbonete, thermoplastic polyester, cellulosic resin, and copolymer of monomer for the above polymer, in addition, thermosetting resin such as modified acrylic resin, phenol resin, melamine resin, and urea resin. The mixing ratio of the binder resin and the magnetic powder should be carefully considered because the ratio significantly affects the magnetization strength of the carrier when used in the magnetic brush developing method. Usually, 100 parts by weight of the binder resin are mixed with 67 through 1000 parts by weight of magnetic powder, preferably 150 through 600 parts of magnetic powder. A magnetic powder less than 67 parts by weight cannot give sufficient magnetism, to transport the toner. If the magnetic powder exceeding 1000 parts by weight is mixed, the binder resin is insufficient to bind the particles, resulting in brittle particles. It is preferable to limit the addition of the carbon (which is added if necessary) to 15 parts or less by weight to 100 parts by weight of the binder resin.

The mean diameter of the carrier affects the charge quantity of the carrier particles, quality of the image to be developed, and the flowability. When the mean diameter is smaller than 15 microns, the flowability lowers. If the mean diameter exceeds 80 microns, the surface of the copied image becomes rough, lowering the image quality.

The carrier according to the present invention may be added as a third component, that is, insulating fine particles of metal oxide such as silica or alumina, in order to prevent the carrier particles from adhering each other.

Since the developer according to the present invention contains mechanically weak capsule toner, it is preferable that a unit such as scraper, which applies mechanical stress to the developer, is not mounted within a developing machine in order to suppress the stress applied to the capsule at a level as low as possible.

The present invention will be illustrated referring to following Examples.

EXAMPLE 1

MANUFACTURE OF MICROCAPSULE TONER

CAPSULE TONER 1

Seventy grams of styrene, 30 grams of n-butyl methacrylate, and 1 gram of Catalyst V-65 (2,2'-azobis(2,4-dimethyl valeronitrile produced by Wako Junyaku Kogyo K. K.) were dissolved into a mixture solvent of 200 grams consisting of ethylacetate and acetone (mixing ratio; 3:1) which contains 50 grams of EPT-1000 (magnetite produced by Toda Kogyo K. K.). The mixture was kneaded in a planetary mill for one hour to prepare a black-magnetic ink. Then 50 grams of ISOPAR H (aliphatic hydrocarbon produced by Esso Standard Corp.) was added to the magnetic ink and evenly dispersed. Next, into the mixture, a solution prepared by dissolving 10 grams of TAKENATE D-102 (isocyanate produced by Takeda Yakuhin K. K.) into 10 grams of ethyl acetate, while cooling the mixture, and sufficiently mixed to obtain a black-ink-isocyanate solution.

On the other hand, 1 liter of a water solution containing of 3% gum arabic (available from Wako Junyaku Kogyo K. K.) and 1% polyvinyl alcohol (produced by Wako Junyaku Kogyo K. K.) was prepared and sufficiently cooled in ice water. The above prepared black-ink-isocyanate solution was added to this gum arabic solution. The mixture was rotated and stirred using an AUTO HOMOMIXER (manufactured by TOKUSHUKIKO K. K.) at a rotation speed of 6000 rpm for 30 min. to obtain fine particles (mean oil particle diameter of approx. 12.3 microns) of a black ink.

Next, 20 grams of 10% solution of hexamethylenediamine (manufactured by Wako Junyaku Kogyo K. K.) was added and reacted for 10 min.; then the solution was gradually heated. While maintaining the solution at 80 through 90° C., the solution was stirred at 2000 rpm for 2 hours, and the stirring operation was continued stirred for 6 hours.

After the reaction, the solution was subjected, three times, to the decantation and rinsing (using pure water) processes in order to remove unreacted substances and gum arabic, as well as excessively fine particles. Then the capsule toner was separated from the liquid by means of a centrifuge. The product was dried at 600° C. for 48 hours and classified, thereby obtaining a capsule toner of 5 through 20 microns. The obtained capsule toner was processed with 0.2% of hydrophobic silica R-972 (manufactured by NIPPON AEROZIL). Thus the obtained toner was designated as capsule toner 1.

Figure 2:
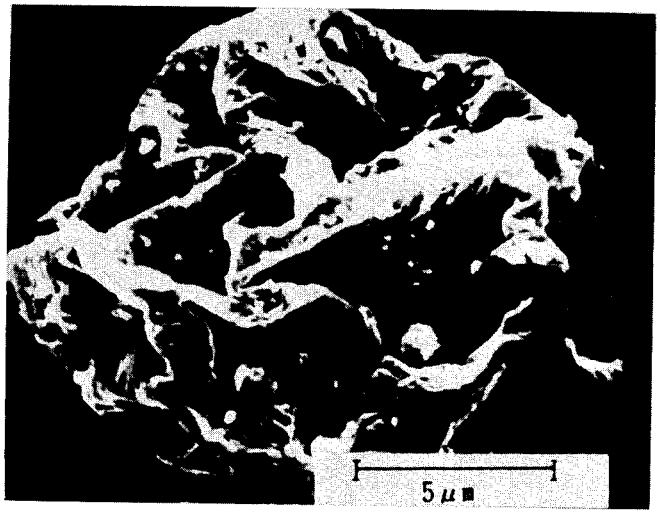
FIG. 2 is an electron micrograph of the capsule toner used in the present invention.
Figure 3:
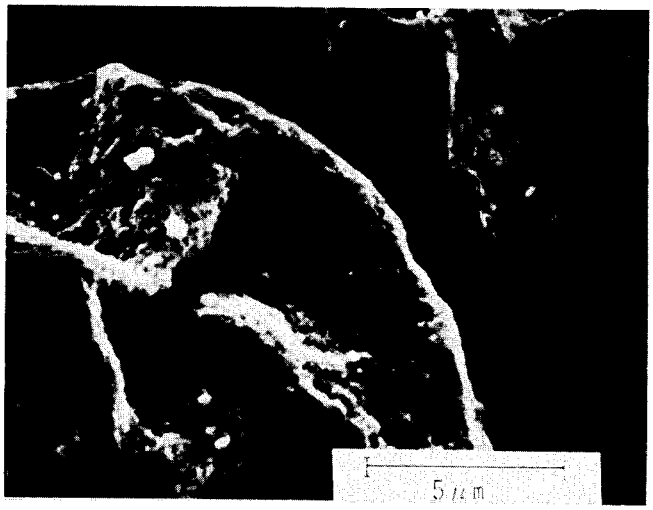
FIG. 3 is an electron micrograph of the same capsule toner of FIG. 2, but magnified more than FIG. 2.

The capsule toner 1 was subjected to SEM observation. As shown in FIG. 2 and FIG. 3 (FIG. 3 is a partially magnified one of FIG. 2), wrinkle-like unevenness was observed on the surfaces of the capsule toner 1. That is, the capsule toner 1 had a rugged shape. The shape factor SF1 of the capsule toner 1 was 153. The number average diameter of the capsule toner 1 was 10.8 μm (≦3 μ:0.4%, ≧20 μm:≦0.5%).

CAPSULE TONER 2

Forty grams of styrene (manufactured by Wako Junyaku Kogyo K. K., first grade reagent), 60 grams of 2-ethylhexylmethacrylate (produced by Wako Junyaku K. K., first grade reagent), and 2 grams of azobisisobutyronitrile (produced by Wako Junyaku K. K., first grade reagent) were dissolved into a mixture solvent of 200 grams consisting of dichlormethane and acetone (mixing ratio of 3:1), into which 60 grams of $CuFe_2O_4$-$CuMn_2O_4$*2 (produced by Dainichiseika K. K.) were added. The mixture was poured into a vibration mill and sufficiently mixed and dispersed to obtain a black-magnetic ink.

*2 $CuFe_2O_4$-$CuMn_2O_4$

The particle size distribution determined by the light transmission type instrument for measuring particle size distribution ranges 0.05 through 1 microns with a mean diameter between approximately 0.1 through 0.2 microns. The oil absorptivity is 35 cc/100 g.

Next, into 150 grams of the mixture obtained, solution prepared by dissolving 10 grams of TAKENATE D-102 (isocyanate produced by Takeda Yakuhin Kogyo K. K.) into 5 grams of ethyl acetate was added while cooling the mixture, and sufficiently mixed to obtain a black-ink-isocyanate solution.

On the other hand, 5% solution of gum arabic (produced by Wako Junyaku K. K.) was prepared and sufficiently cooled in ice water. The above prepared black-ink-isocyanate solution was added to this gum arabic solution. The mixture was rotated and stirred using an AUTO HOMOMIXER (manufactured by TOKUSHUKIKO K. K.) at a rotation speed of 6000 rpm for 30 min. to obtain fine particles of black ink.

Next, 25 grams of 10% solution of hexamethylenediamine (manufactured by Wako Junyaku K. K.) was added and reacted for 10 min.; then the solution was gradually heated and stirred at 2500 rpm for 2 hours.

While maintaining the solution at 80 through 90° C., the solution was stirred for another 6 hours, then the reaction process was terminated.

After the reaction process, the solution was subjected, three times, to the decantation and rinsing (using pure water) processes in order to remove unreacted substances and gum arabic, as well as excessively fine particles. Then the dispersed solution was dried by a spray method.

The product was heated and dried at 60° C. for 36 hours, and classified by a blow classifier, thereby obtaining a capsule toner 2 having a number average diameter of 11.2 μm (≦3 μm:0.1%, ≧20 μm:1.2%). The obtained capsule toner was processed with 0.2% of hydrophobic silica R-972 (manufactured by NIPPON AEROZIL). Thus obtained toner was designated as capsule toner 2.

The capsule toner 2 was subjected to SEM observation. Unevenness was observed on the particle surface of the capsule toner 2. That is, the capsule toner 2 had wrinkled or rugged shape as shown in FIG. 3. The shape factor SF1 of the capsule toner 2 was 161.

CAPSULE TONER 3

Fifty grams of ETP-1000 (magnetite manufactured by Toda Kogyo K. K.), 50 grams of tridecyl methacrylate, 30 grams of n-buthyl methacrylate, and 1 gram of azobisisobutyronitrile (catalyst) were dissolved into a mixture solvent of 50 grams consisting of dichloromethane and acetone (mixing ratio of 3:1) which contains 80 grams of ISOPER H. The mixture was poured into a ball mill and mixed for 3 hours to obtain a black-magnetic ink.

Next, into the mixture, a solution prepared by dissolving 15 g of TAKENATE D-102 (isocyanate produced by Takeda Yakuhin Kogyo K. K.) into 8 g of ethyl acetate was added while cooling the mixture, and sufficiently mixed to obtain a black-ink-isocyanate solution.

On the other hand, 1 liter of 5% solution of gum arabic (produced by Wako Junyaku Kogyo K. K.) was prepared and sufficiently cooled in ice water. The above prepared black-ink-isocyanate solution was added to this gum arabic solution. The mixture was rotated and stirred using an AUTO HOMOMIXER (manufactured by TOKUSHUKIKO K. K.) at a rotation speed of 4000 rpm for 30 min. to obtain fine particles (mean oil particle diameter of approx. 12 through 12.5 microns) of a black ink.

Next, 25 grams of 10% solution of hexamethylenediamine (manufactured BY Wako Junyaku K. K.) was added and reacted for 10 min.; then the solution was gradually heated. While maintaining the solution at 60° C., the solution was stirred at 2000 rpm for 2 hours, and stirred for 6 hours at 85° C., then the reaction process was terminated.

After the reaction process, the solution was dehydrated and rinsed using pure water, removing unreacted substances and gum arabic; then the product was dried and classified, thereby obtaining capsule toner of 11.3 μm of number average diameter (≦3 μm:0.1%, ≧20 μm:1.2%). The obtained capsule toner was processed with 0.2% of hydrophobic silica R-972 (manufactured by NIPPON AEROZIL). Thus obtained toner was designated as capsule toner 3.

The capsule toner 3 was subjected to SEM observation. As shown in FIG. 3, wrinkle-like unevenness was observed on the surfaces of the capsule toner 3, which had a number average diameter of 12,9 μm (≦3 μm:0%, ≧20 μm:1.8%). That is, the capsule toner 3 was formed in rugged shape. The shape factor SF1 of the capsule toner 3 was 153.

CAPSULE TONER 4

Fifty gram of ETP-1000 (magnetite manufactured by Toda Kogyo K. K.), 80 grams of n-butyl methacrylate, and 1 gram of V-65 (catalyst, 2,2'-azobis(2,4-dimethylvaleronitrile) manufactured by Wako Junyaku K. K.) were added into solution of 50 grams of acetone and 80 grams of ISOPER H. The mixture was poured into a ball mill and mixed for 3 hours to obtain a black-magnetic ink.

Next, into the mixture, solution prepared by dissolving 15 g of TAKENATE D-102 (produced by Takeada Yakuhin Kogyo K. K.) into 8 g of ethyl acetate was added while cooling the mixture, and sufficiently mixed to obtain a black-ink-isocyanate solution.

The solution was processed in the same manner as that used for obtaining the capsule toner 3, thereby the capsule toner 4 was obtained, which had a number average diameter of 12,9 μm (≦3 μm:0% ≧20 μm:1.8%).

Figure 4:
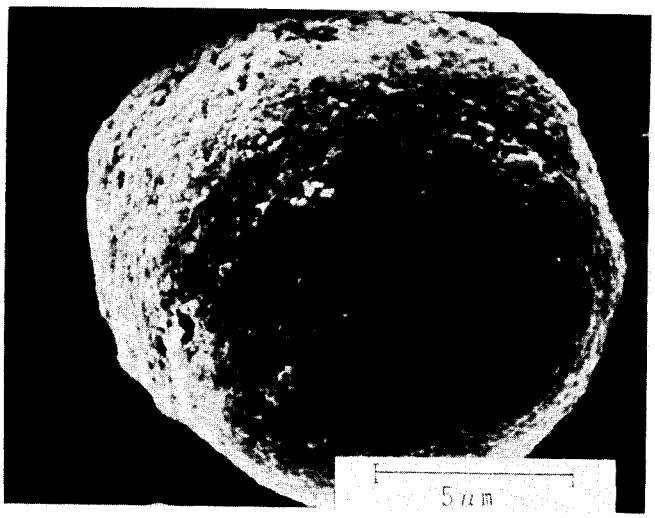
FIG. 4 is an electron micrograph of the capsule toner used in a comparative example.

The capsule toner 4 was subjected to SEM observation, and the surface structure of toner particles is shown in FIG. 4 on the particle surfaces of the capsule toner 4, unevenness was not observed, that is, the toner was formed in sphere shape. The shape factor SF1 of the capsule toner 4 was 110.

CAPSULE TONER 5

Seventy gram of styrene, 30 grams of n-butyl methacrylate, 2 g of azobisisobutyronitrile, 5 grams of nigrosine base EX (nigrosine-family, oil-soluble dye produced by ORIENT KAGAKU K. K.), and 7 grams of carbon black R-400R (produced by CABBOT) were mixed. The mixture was poured into one liter of 5% solution of gum arabic while cooling the solution. The solution was then rotated at a high speed of 7000 rpm in a HOMOMIXER, thereby obtaining fine suspended particles. The suspension was heated and polymerized at 60° C. for 3 hours, and then at 90° C. for 3 hours, thus the capsule toner 5 was obtained, which had a number average diameter of 11,1 μm (≦3 μm:0.3%, ≧20 μm:0.8%).

Figure 8:
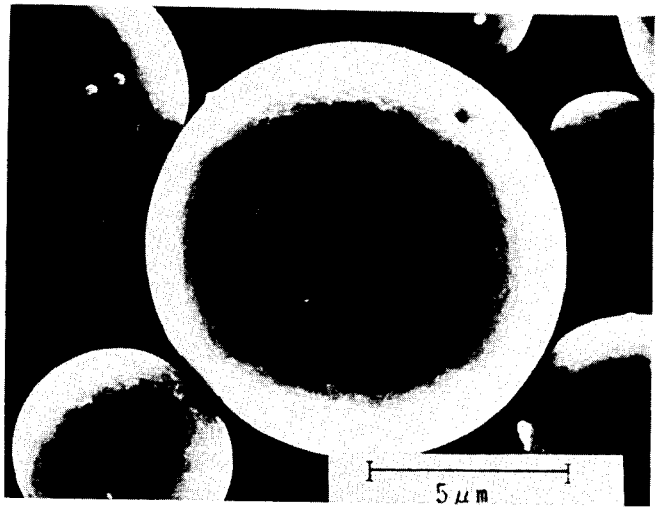
FIG. 8 is an electron micrograph of a conventional capsule toner in a comparative example.
Figure 6:
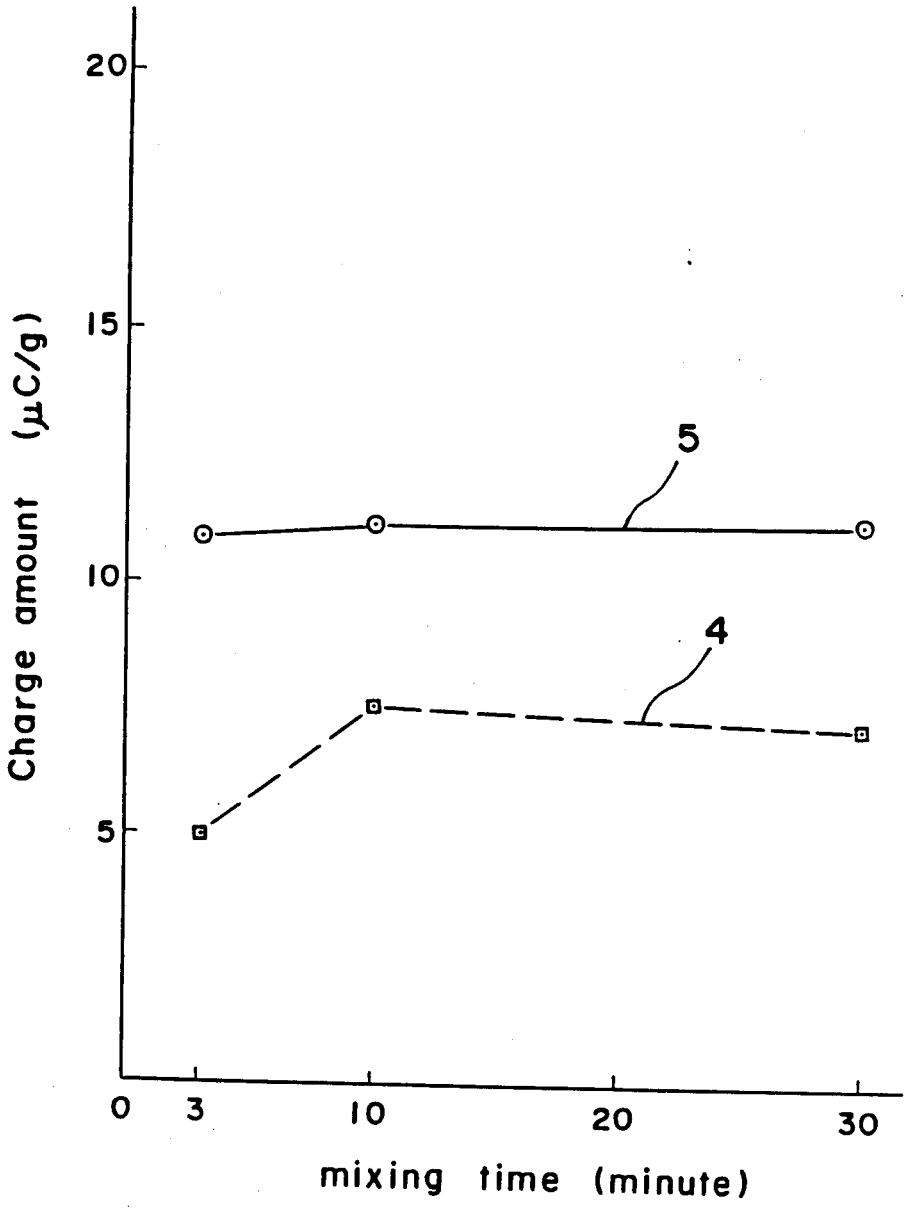
FIG. 6 is a graph showing the change quantity of toner when the developer is mixed and stirred.

The capsule toner 5 was subjected to SEM observation. On the particle surfaces of the capsule toner 5, unevenness was not observed, that is, the toner was formed in sphere shape, as shown in FIG. 8. The shape factor SF1 of the capsule toner 5 was 105.

PRODUCTION OF CARRIER

Carrier A

Magnetite (BL-SP produced by Titan Kogyo K. K.): 500 parts

Styrene/acryic copolymerized resin (PRIOLITE ACL produced by GOODYEAR CHEMICAL): 100 parts Silica (#200 produced by NIPPON AEROZIL): 2 parts The above compositions were sufficiently mixed using a SUPER MIXER. After kneading the mixture using a double-axes extruding/kneading machine, the mixture was cooled and coarse-ground. The product was ground using a hammer mill to obtain a mean particle diameter of 50 microns. The obtained product was further classified using a blower classifier and course and fine particles were removed, thereby carrier A having a mean particle diameter of 40 microns was obtained. Its true specific weight was 3.3.

The particle diameter of the carrier was measured by using a MICROTRUCK (model 7995-10 SRA, manufactured by NIKKISO), and the mean value was obtained. The same procedure was used for carrier B through M.

Carrier B

Carrier B was obtained from the same compositions and using the same procedures as those used for the carrier A. The mean particle diameter and true specific weight of the carrier B were 60 microns and 3.3, respectively.

Carrier C

Magnetite (BL-SP produced by Titan Kogyo K. K.): 700 parts

Styrene/acryic copolymerized resin (PRIOLITE ACL produced by GOODYEAR CHEMICAL): 100 parts Silica (#200 produced by NIPPON AEROZIL): 5 parts The above compositions were used in the same manner as that used for the carrier A in order to obtain carrier C. The mean particle diameter and true specific weight of the carrier C were 78 microns and 4.0, respectively.

Carrier D

Magnetic powder (ETP-1000 produced by Toda Kogyo Corp.): 500 parts

Bisphenol type polyester resin (softening point: 123° C., transformation point to glass structure: 65° C., AV; 21, OHV; 43, Mn; 7,600, Mw; 188,400): 100 parts Carbon black (MA#8 produced by Mitsubishi Kasei Kogyo K. K.): 2 parts The above compositions were used in the same manner as that used for the carrier A in order to obtain carrier D. The mean particle diameter and true specific weight of the carrier D were 61 microns and 3.2, respectively.

Carrier E

Carrier E was obtained in the same compositions and the same manner as those used for the carrier C except that the mean particle diameter was 90 microns and the true specific weight was 4.0.

Carrier F

Iron powder carrier (TEF V 250/400 produced by NIHON TEPPUN) having a mean particle diameter of 50 microns and a true specific weight of 7.6 was used as carrier F.

Carrier G

Ferrite carrier (FMC-6 produced by TDK Corporation) having a mean particle diameter of 40 microns and a true specific weight of 5.22 was used as carrier G. The carrier G was substantially spherical in shape, and the shape factors SF1 and SF2 were 134 and 112, respectively.

Carrier H

Iron alloy wire, consisting of 0.1 wt % of silicon, 1.0 wt % of manganese, and 98.9 wt % of iron, was attached to a well-known electric wire gun. A high electric current was applied to the wire in order to generate discharging and to fuse the wire. At the same time, nitrogen gas of a high pressure was introduced to atomize the melt alloy in water, thereby an iron powder was obtained. The atomized powder was classified using a blower classifier to obtain a particle having a mean diameter of 50 microns. This carrier was designated as carrier H. The carrier H was substantially spherical in shape, and the shape factors SF1 and SF2 were 128 and 108, respectively.

Carrier I

Coated ferrite carrier (F-182-2540 produced by NIHON TEPPUN), made of styrene-acryic resin and having a mean particle diameter of 70 microns and a true specific weight of 5.2, was designated as carrier I. The carrier I was substantially spherical in shape, and the shape factors SF1 and SF2 were 128 and 113, respectively.

Carrier J

Magnetite (BL-SP produced by Titan Kogyo K. K.): 700 parts

Styrene/acryic copolymerized resin (PRIOLITE ACL produced BY GOODYEAR CHEMICAL): 100 parts Silica (#200 produced by NIPPON AEROZIL): 5 parts The above compositions were sufficiently mixed using a SUPER MIXER. After kneading the mixture using a double-axes extruding/kneading machine, the mixture was cooled and coarse-ground. The product was ground using a hammer mill to obtain a mean particle diameter of 90 microns. The obtained particles were made spherical thermal treatment using a SPILER FLOW (produced by FROINT SANGYO K. K.). After this treatment, aggregated particles were removed using a screen of 125 microns, thus carrier J having a mean particle diameter of 83 microns and a true specific weight of 4.0 was obtained. The carrier J was substantially spherical in shape, and the shape factors SF1 and SF2 were 158 and 124, respectively.

Carrier K

Iron carrier, having a mean particle diameter of 100 microns and a true specific weight of 7.6, was designated as carrier K. The carrier K was irregular in shape, and the shape factors SF1 and SF2 were 178 and 132, respectively.

Carrier L

Carrier L, having a mean particle diameter of 85 microns and a true specific weight of 4.0, was produced using the same production method as that used for the carrier J except that the thermal treatment was omitted. The shape factors SF1 and SF2 were 172 and 138, respectively.

PREPARATION OF DEVELOPER

The capsule toners 1 through 5 and the carriers A through L were combined and mixed in the combination pair and mixing ratio shown in Table 1 in order to prepare developers. The obtained developers were subjected to evaluation tests 1 through 7 as shown below. In the above-mentioned developers, those employing magnetic capsule toner (toner 1, 3, or 4) were tested using the modified machine below: the photoconductive drum of a PPC EP-350Z, which is produced by Minolta Camera Co., Ltd., and has both sleeve- and magnet-roller-rotating type developing units, was replaced with a photoconductive drum of a EP-360Z. At the same time, the fixing unit was replaced with one of pressure-adjustable type. The developers employing non-magnetic capsule toner (toner 2 or 5) were tested using the modified machine below: the fixing unit of a PPC EP-360Z, which is produced by Minolta Camera Co., Ltd., and has sleeve-rotating type developing unit, was replaced with a fixing unit of pressure-adjustable type. Thus, each developer was evaluated with regard to items from (1) through (7).

Evaluation methods of characteristics (1) Quantity of charge

One liter of each developer prepared above was poured into a polyethylene bottle and stirred at a rotation speed of 120 rpm for 3 hours, and then the charge quantity of toner was measured.

(2) Initial image density

Each developer stirred in advance using the above-mentioned procedures was subjected to copying operation using the above-mentioned copying machine, and then the image density was measured using a SAKURA reflection densitometer (manufactured by Konishiroku ShashinKogyo K. K.)

(3) Fog ranking

After making copying test of 500, 2000, and 5000 sheets, each image quality was evaluated and ranked as follows:

◎ : No fogging

○: Substantially no fogging,

Δ: Although fogging appears, it is permissible from a view point of practical use, ×: Fogging appears and is not allowed.

(4) Fixation ability by pressure:

Peel tests was carried out, using an adhesive tape, on copied sheets, on which the toner was fixed by pressure of 100 kg/cm$^2$ and 300 kg/cm$^2$, and ranked as follows:

◎ : No peeling occurs,

○: Although partial and thin peeling occurs, it is permissible from a view point of practical use, Δ: copied image is partially peeled off, ×: Most of image are peeled off, and cannot be subjected to practical use.

(5) Breakage of capsule toner in developing unit

Deterioration of developer (especially, breakage of capsule toner) was observed and evaluated using an electron microscopy after making copying test of 500, 2000, and 5000 sheets, ○: No damaged toner particle was found after making 5000 copied sheets.

Δ: Although no damaged toner particle was found after making 500 copied sheets, damaged toner particles were observed after making 2000 copied sheets. The number of damaged toner particles increased after making 5000 copied sheets, ×: Damaged toner particles were found after making 500 copied sheets. The number of damaged toner particles further increased after 2000 and 5000 copied sheets.

(6) Ability-to-be-cleaned

○: No problem was occurred after making 5000 copied sheets.

Δ: Although several black streaks were generated on the photoconductive drum after making 5000 copied sheets, the effects were slight.

×: Black streaks were generated on the photoconductive drum after making 500 copied sheets, and the number of streaks further increased after making 2000 and 5000 copied sheets.

(7) Filming resistance

: No problem was occurred after making 5000 copied sheets.

: Filming were generated on the photoconductive drum after making 5000 copied sheets, the density of the image lowered, or fog was generated on the image.

: Filming were generated on the photoconductive drum after making 500 copied sheets, and density of the image lowered, or fog was generated on the image.

As apparent from the results shown in Table 1, neither scattering of the toner nor fog were observed in the developer of the present invention because of its stable chargeability. Damage of the capsule toner hardly occurs in the present developer, and then the coagulation of the developer seldom occurs, and shows an excellent cleaning Stability of chargeability Chargeabilities on the toners 3, and 4 at start, which were incorporated into a binder type carrier respectively were determined by the following method.

The obtained developers were put in polyethylene bottles respectively, rotated at 120 rpm, and then charge amount on each toner was determined at 3, 10 and 30 minutes later. The results were shown in FIG. 7. As apparent from the FIG. 7 the charge amount on the toner 3 (SF1=153, shown by plot (5)) was immediately charged to maximum level just after rotation whereas the toner 4 (SF1=110, shown by plot (4)) needed longer time to reach the level.

| Example/ Comparison | developer: Capsule toner | developer: carrier | developer: concentration of toner | quantity of charge (μC/g) | initial image density | Fog ranking | Fixation ability by pressure: 100 Kg/cm$^2$ | Fixation ability by pressure: 300 Kg/cm$^2$ | Breakage of capsule toner | cleaned-ability | Filming resistance |
|---|---|---|---|---|---|---|---|---|---|---|---|
| Example 1 | 1 | B | 40 | +12.5 | 1.3 | | ○ | ○ | ○ | ○ | ○ |
| Example 2 | 1 | C | 40 | +10.3 | 1.4 | | ○ | ○ | ○ | ○ | ○ |
| Example 3 | 1 | D | 40 | +12.0 | 1.3 | | ○ | ○ | ○ | ○ | ○ |
| Example 4 | 2 | A | 10 | +14.5 | 1.2 | | ○ | | ○ | ○ | ○ |
| Example 5 | 2 | B | 10 | +12.9 | 1.3 | | ○ | | ○ | ○ | ○ |
| Example 6 | 2 | C | 10 | +11.3 | 1.4 | | ○ | | ○ | ○ | ○ |
| Example 7 | 2 | D | 10 | +11.9 | 1.3 | | ○ | | ○ | ○ | ○ |
| Example 8 | 3 | A | 40 | +12.9 | 1.3 | | ○ | ○ | ○ | ○ | ○ |
| Example 9 | 3 | B | 40 | +11.5 | 1.4 | | ○ | ○ | ○ | ○ | ○ |
| Comparison 1 | 1 | E | 40 | +8.8 | 0.9 | ○ | ○ | ○ | Δ | ○ | Δ |
| Comparison 2 | 2 | K | 5 | +10.0 | 1.4 | | ○ | | × | ○ | × |
| Comparison 3 | 2 | F | 5 | +12.5 | 1.3 | | ○ | | Δ | ○ | Δ |
| Comparison 4 | 4 | A | 40 | +6.2 | 0.8 | × | × | × | ○ | × | × |
| Comparison 5 | 5 | C | 10 | +4.3 | 0.5 | × | × | Δ | ○ | × | × |

-continued

| Example/ Comparison | developer: Capsule toner | developer: carrier | developer: concentration of toner | quantity of charge (μC/g) | initial image density | Fog ranking | Fixation ability by pressure: 100 Kg/cm² | Fixation ability by pressure: 300 Kg/cm² | Breakage of capsule toner | cleaned-ability | Filming resistance |
|---|---|---|---|---|---|---|---|---|---|---|---|
| Comparison 6 | 5 | D | 10 | +5.6 | 0.6 | × | × | Δ | O | × | × |
| Example 10 | 1 | G | 40 | 11.8 | 1.3 | | O | O | O | O | O |
| Example 11 | 2 | H | 5 | 16.6 | 0.9 | | O | | O | O | O |
| Example 12 | 2 | I | 10 | 12.9 | 1.3 | | O | | O | O | O |
| Example 13 | 3 | I | 40 | 11.9 | 1.3 | | O | O | O | O | O |
| Example 14 | 2 | J | 10 | 13.1 | 1.3 | | O | : | O | O | O |
| Comparison 7 | 1 | K | 30 | 7.6 | 0.7 | O | O | O | × | Δ | × |
| Comparison 8 | 3 | L | 40 | 8.2 | 1.0 | O | O | O | × | Δ | × |
| Comparison 9 | 2 | L | 10 | 10.9 | 1.4 | O | O | | × | Δ | × |

*a large quantity of toner particles scatter.

What is claimed is:

1. A developer for developing electrostatic latent image, which comprises:

(1) a capsule toner having an irregular shape and a wrinkled surface as substantially depicted in FIG. 2, in which a core material comprises at least, a solvent of high boiling point and a resin for fixing and a coloring agent, both of which are dissolved in or dispersed in the solvent, wherein the core material is enclosed in a shell material containing a chargeable resin, said capsule toner having a mean particle diameter of from 3 to 25 microns; and (2) a carrier, which has no sharp edge corner, or has a low true specific gravity.

2. A developer of claim 1, in which the shell of toner is made from isocyanates and at least one of polyols and polyamines.

3. A developer of claim 1, in which the shell of the capsule toner has a thickness of from 0.01 0.8 micron.

4. A developer of claim 1, in which the solvent contained in the capsule toner is an aliphatic hydrocarbon which may have at least one of a branch and an organic polysiloxane.

5. A developer of claim 1, in which the solvent contained in the capsule toner has a boiling point of from 150° C. to 350° C.

6. A developer of claim 1, in which the core material in the toner additionally contains a solvent having a lower boiling point.

7. A developer of claim 1, in which the resin in the toner is derived from the polymerization of one or more of the monomers selected from the group consisting of acrylic acid esters, methacrylic acid esters, styrene and vinyl monomers.

8. A developer of claim 1, in which the carrier is substantially spherical.

9. A developer of claim 1, in which the capsule toner is contained at 1 to 20% by weight in the case of a non-magnetic toner, or at 20 to 60% by weight in the case of a magnetic toner.

10. A developer of claim 1, in which the capsule toner has a shape factor (SF1) expressed by the following equation and is within the range shown below:

$$SF1=\{(\text{maximum length})^2/\text{area}\}\times(\text{pai}/4)\times 100,\quad 120\leqq SF1\leqq 180$$

wherein the maximum length is the longest distance between any two points on the circumferential of the particle projection and the area is a projection area of the particle.

11. A developer for developing electrostatic latent image of the claim 1, in which said capsule toner is formed by a process comprising a step of mixing at least a high boiling point solvent, a first shell forming monomer, a fixing monomer, a polymerization initiator and colorant to make a dispersion; a step of emulsifying the dispersion into fine oil drops in an aqueous medium containing a second shell forming monomer; and a step of forming the shell around the oil drops by means of interfacial polymerization between said first and second shell forming monomers and simultaneously or subsequently polymerizing the fixing monomer in the dispersion by means of in-situ polymerization.

12. A developer of claim 1, in which the carrier has a mean particle diameter of 80 microns or less and a true specific gravity of from 1.0 to 4.5.

13. A developer of claim 1, in which the carrier has a shape factor (SF1) expressed by the following equation within the range shown below:

$$SF^1=\{(\text{maximum length})^2/\text{area}\}\times(\text{pai}/4)\times 100,\quad 100\leqq SF1\leqq 170$$

wherein the maximum length is the longest distance between any two points on the circumferential of the particle projection and the area is a projection area of the particle.

14. A developer of claim 1, in which the carrier has a shape factor (SF2) expressed by the following equation within the range shown below:

$$SF2=\{(\text{circumferential length})^2/\text{area}\}\times 100/4\text{pai}\quad 100\leqq SF2\leqq 140$$

wherein the circumferential length is a circumferential length of the particle projection and the area is a projection area of the particle.

15. A developer of claim 14, in which the carrier has a shape factor (SF2) of from 100 to 130.

16. A developer for developing electrostatic latent image, which comprises:

(1) a capsule toner having an irregular shape and a wrinkled surface as substantially depicted in FIG. 2, in which a core material comprises a resin for fixing a coloring agent, wherein the core material is enclosed in a shell material containing a chargeable resin, said capsule toner having a mean particle diameter of from 3 to 25 microns; and (2) a carrier having at least one of a no sharp edge corner and a true specific gravity of from 1.0 to 4.5.

17. A developer of claim 16, in which said toner is mixed with an insulating fine particle for preventing adhesion between the toner and the carrier, said insulating fine particle selected from silica and alumina.

18. A developer for developing electrostatic latent image, which comprises a toner having an irregular shape and a wrinkled surface as substantially depicted in FIG. 2, in which the toner comprises a resin for fixing and a coloring agent, said toner having a mean particle diameter of from 3 to 25 microns.

* * * * *